US005741034A

United States Patent [19]

Bains et al.

[11] Patent Number: 5,741,034

[45] Date of Patent: Apr. 21, 1998

[54] ELECTROMAGNETIC DOOR HOLDER APPARATUS

[75] Inventors: Gurdev S. Bains, Wolcott, Conn.; Hilario S. Costa, Sarasota, Fla.

[73] Assignee: General Signal Corporation, Stamford, Conn.

[21] Appl. No.: 537,485

[22] Filed: Oct. 2, 1995

[51] Int. Cl.[6] ..... E05C 17/44

[52] U.S. Cl. ..... 292/338; 292/251.5

[58] Field of Search ..... 292/251.5, 338, 292/DIG. 19; 403/114, 76, 122, 115, 142

[56] References Cited

U.S. PATENT DOCUMENTS

| | | | |
|---|---|---|---|
| Re. 27,161 | 8/1971 | Raymon | 292/338 |
| 755,058 | 3/1904 | Shaw | 292/338 |
| 1,566,805 | 12/1925 | Ackerman | 292/338 |
| 2,394,276 | 2/1946 | Venditty | 403/24 |
| 2,768,850 | 10/1956 | Minnis, Jr. | 292/338 |
| 3,781,047 | 12/1973 | Surko, Jr. | 292/251.5 |
| 3,913,958 | 10/1975 | Larime | 292/251.5 |
| 4,076,293 | 2/1978 | Valles | 292/338 |
| 4,215,885 | 8/1980 | McCray | 292/338 |
| 4,669,766 | 6/1987 | Hanchett, Jr. et al. | 292/251.5 |
| 4,852,919 | 8/1989 | Nimee et al. | 292/251.5 |
| 4,858,972 | 8/1989 | Salyer | 292/338 |
| 4,979,769 | 12/1990 | Salyer | 292/338 |
| 5,139,293 | 8/1992 | Zimmerman et al. | 292/251.5 |

*Primary Examiner*—Rodney M. Lindsey

*Attorney, Agent, or Firm*—Milton E. Kleinman; Robert R. Hubbard; Robert S. Smith

[57] ABSTRACT

A door holder assembly for use with an associated electromagnet and an associated door having a pneumatic or hydraulic door closer mechanism mounted thereon which includes an elongated body having first and second axial portions. The apparatus includes a threaded member coupled to the first axial portion and to the second axial portion, the threaded member is coupled to one of the axial portions by mating threaded surfaces whereby relative rotation of the first and second axial portions varies the combined axial extent of the elongated body. The assembly further including a plate at one end of the elongated body and a base at the other end of the elongated body, the base and the plate are each mounted on the elongated body by means that allows relative angular movement therebetween. In some forms of the invention the first and second axial portions are disposed in telescoping relationship and each of the axial portions are cylindrical. In other embodiments of the invention the first and second axial portions are axially spaced at all times. In such forms of the invention the threaded member is a rod having external threads and each of the first and second axial portions have internal threads dimensioned and configured for cooperation with the threads on the rod.

2 Claims, 4 Drawing Sheets

ELECTROMAGNETIC DOOR HOLDER APPARATUS

BACKGROUND OF THE INVENTION

The invention relates to building systems and particularly to door holder apparatus. Commercial buildings are often provided with electromagnetic door holder apparatus. The apparatus holds a door in the open position as long as electric power is supplied to an electromagnet. The electromagnet is typically fixed to a wall near an edge of the open door. More specifically, the electromagnet is disposed near the edge of the open door that is nearest to the door and farthest from the hinge mounting for the door. The electromagnet is traditionally mounted on the wall rather than the door to avoid the need to supply electrical power to a door that is pivotally connected to a door frame.

The door holder apparatus includes a plate or other element manufactured of a metal that will be attracted by the electromagnet. The plate is mounted by a standoff that holds the plate at a distance from the wall. Typically the door holder at each of a number of doors is part of a system that enables closing of one or more doors from a central location. Those skilled in the art will recognize that closing of one or more doors may be desirable in the event of a fire or merely for control of heating, ventilating, or air conditioning systems. It will be further understood that the present invention merely released a hold on the door and the actual door closing will typically be accomplished by a hydraulic or pneumatic door closer that is not part of the present invention.

The prior art includes various supports for the plate or other member that is attracted by the electromagnet. Often they have not been wholly satisfactory because they do not provide sufficient adjustment. For example, many have little ability to adjust the distance between the wall on which the electromagnet is mounted and the door. Many known devices have not allowed sufficient adjustment in the angular relationships between a base that supports a straight standoff shaft and the shaft itself although the prior art does include a door holder apparatus, manufactured by the Edwards Division of G S Building Systems Corp., a unit of General Signal Corporation, that provides a ball and socket mounting between the base and the standoff. Other known devices have not provided angular adjustment between the plate that cooperates with the electromagnet and the shaft of the standoff.

It is desirable to be able to make such adjustments so that a user may either avoid obstructions that may be present or merely to precisely locate the exact position of the fully open door. Many of the prior art devices may mount the plate that cooperates with the electromagnet in a manner that results in the planar face of the electromagnet being disposed at an angle to the planner face of the plate. It is preferable that the planar face of the plate and the planner face of the electromagnet meet in parallel face to face contact to insure optimum magnetic coupling between the electromagnet and the plate.

In an ideal world it would be logical to provide (1) a base for the standoff on the door that would position a straight standoff in perpendicular relationship to the door, (2) the plate that cooperates with the electromagnet would be disposed in perpendicular relationship to the straight standoff, (3) the planar face of an electromagnet would be mounted in perpendicular relationship to the axis of the standoff, and (4) the planar face of the electromagnet and the planar face of the plate would meet in planar face to planar face abutting relationship. Often obstructions on the wall or door do not allow mounting of both a support fixed to the wall and the planar face of the plate in normal relation to a perpendicular line extending to the wall.

The prior art includes devices that allow variations in the length of the standoff by adding axial sections of fixed length such as 1.0, 1.5, 2.0, and 3.0 inches to the standoff. The axial sections in the known apparatus each have a male threaded end and a female threaded end. This form of the prior art is not wholly satisfactory because the finite length of the axial sections may not coincide with the requirements of the installation.

It is an object of the invention to provide apparatus that allows substantially infinite adjustment of the axial extent of the standoff in a door holder apparatus.

Another object of the invention is to provide apparatus that allows angular adjustment of both the plate and base for a standoff in a door holder apparatus. Still another object of the invention is to provide apparatus that will simplify installation by facilitating installation at job sites that have obstructions on the wall, on the door or in the area between the wall and the door.

It is an object of the invention to provide apparatus which is inexpensive to manufacture as well as requires a minimum of labor to install.

SUMMARY OF THE INVENTION

It has now been found that these and other objects of the invention may be attained in a door holder assembly for use with an associated electromagnet and an associated door having a pneumatic or hydraulic door closer mechanism mounted thereon which includes an elongated body having first and second axial portions. The apparatus includes a threaded member coupled to the first axial portion and to the second axial portion, the threaded member being coupled to one of the axial portions by mating threaded surfaces whereby relative rotation of the first and second axial portions varies the combined axial extent of the elongated body. The assembly further including a plate at one end of the elongated body and a base at the other end of the elongated body, the base and the plate are each mounted on the elongated body by means that allows relative angular movement therebetween.

In some forms of the invention the means that allows relative angular movement at a first end of the elongated body is a pivot connection and the means that allows relative angular movement at a second end of the elongated body is a ball and socket connection. The first and second axial portions are disposed in telescoping relationship in some forms of the invention. Each of the axial portions may be cylindrical and the threaded member may be a rod.

The rod is fixed to the interior of one of the axial portions in some forms of the invention. The second axial portion may include internal threads dimensioned and configured for mating engagement with the threads on the rod. In some forms of the invention the connection between the elongated member and the base may be a ball and socket connection and the connection between the elongated member and the plate is a pivot connection.

In other embodiments of the invention the first and second axial portions are axially spaced at all times. In such forms of the invention the threaded member is a rod having external threads and each of the first and second axial portions have internal threads dimensioned and configured for cooperation with the threads on the rod. The assembly may further include an axially extending rubber boot that covers the axial portion of the elongated member intermediate the first and second axial portions.

The rubber boot may be convoluted to allow for variations in the axial spacing intermediate the first and second axial portions. The base may be coupled to the elongated member by a ball and socket connection and the plate may be coupled to the elongated member by a pivot connection. A set screw engages a bore in one of the axial portions and abuts against the rod to prevent relative axial movement.

The ball and socket connection may include first and second opposed spherical section shaped members and the ball may include first and second hemisphere shaped elements connected to the elongated member.

BRIEF DESCRIPTION OF THE DRAWING

The invention will be better understood by reference to the accompanying drawing in which.

DESCRIPTION OF THE PREFERRED EMBODIMENT

Figure 1:
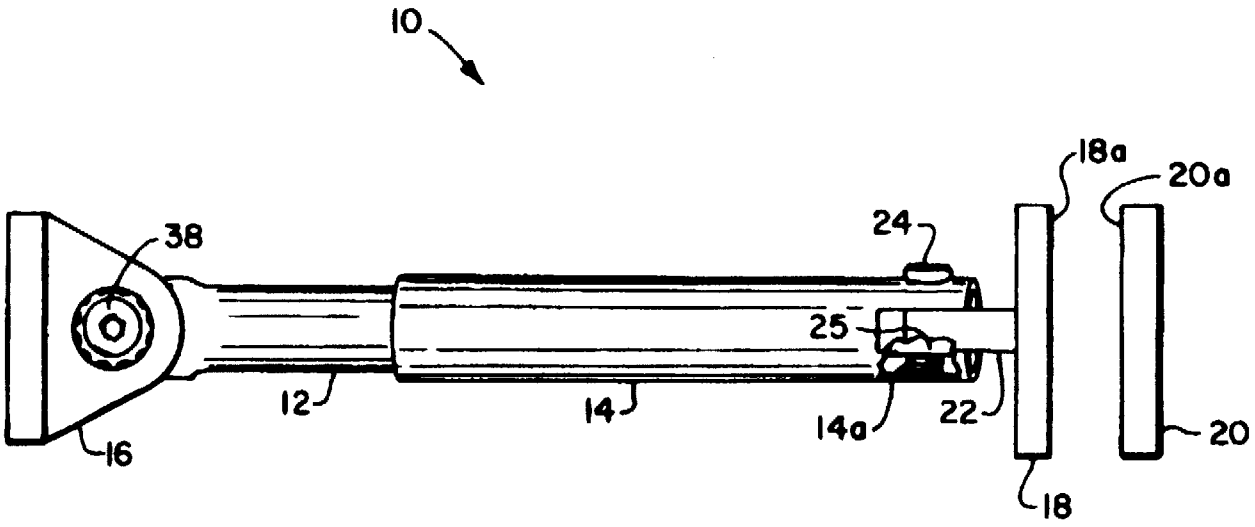
FIG. 1 is a plan view of a first embodiment of the present invention.
Figure 2:
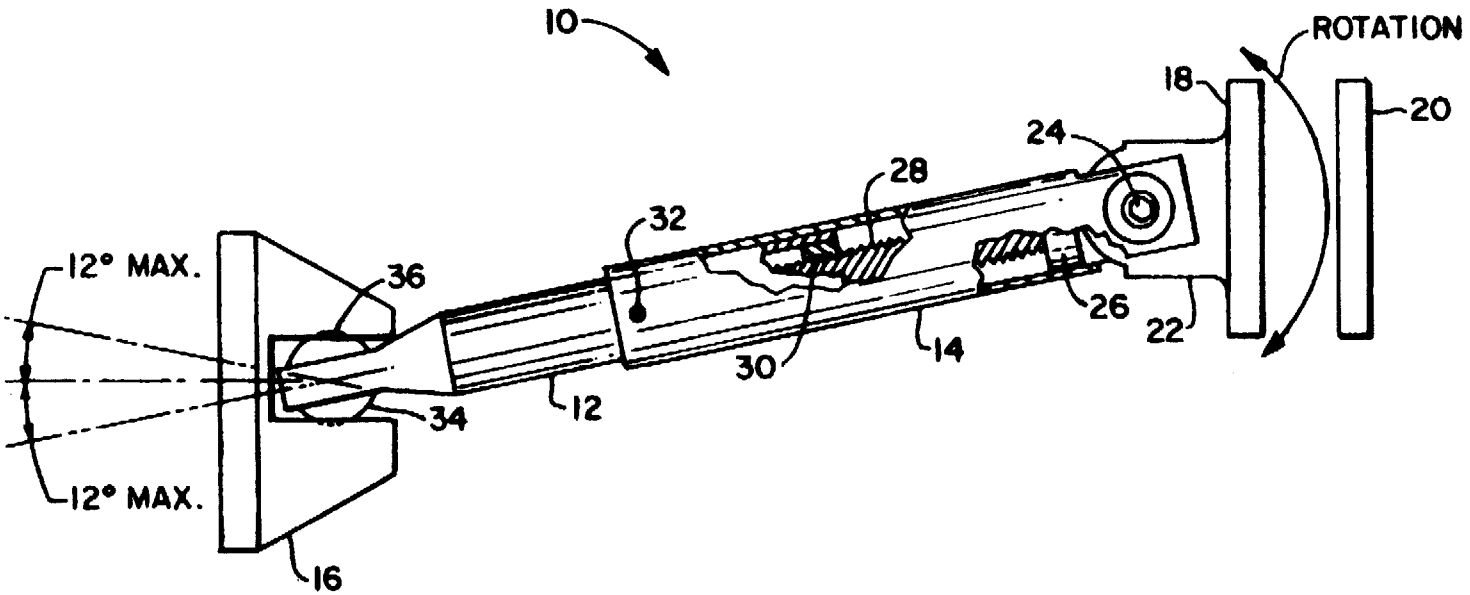
FIG. 2 is a side view of the embodiment of FIG. 1.

Referring now to FIGS. 1 and 2 there is shown a first embodiment of the invention in which a door holder 10 includes first and second telescoping sleeves 12, 14. The sleeves 12, 14 connect a bracket 16 to a plate 18. The plate cooperates with a schematically represented electromagnet 20. The electromagnet 20 is fixed to the wall of a building (not shown) in a normal installation. Power to the electromagnet 20 is controlled from a central panel (not shown).

The plate 18 has a planar face **18*a* that preferably contacts a planar face 20*a* of the electromagnet 20 with planar face to planar face abutting relationship. This relationship provides the best magnetic coupling and the most positive holding of the door (not shown) that is fixed to the base 16. The plate 18 is provided with a plate shaped tab 22. The right (as viewed) axial extremity of the sleeve 14 is slotted to form a yoke that is coupled to the tab 22 by a screw 24 that engages the yoke on the right end (as viewed) of the outer sleeve 14. More specifically, the right end of the outer sleeve 14 is provided with a threaded insert 14*a* that is disposed with the axis thereof in radial orientation to the outer sleeve 14. The screw 24 extends through a bushing 25 disposed in a hole in the tab 22. The bushing 25 facilitates smooth relative movement between the tab 22 and the screw 24 within the yoke at the right end of the outer sleeve 14**.

As best seen in FIG. 2 the outer sleeve 14 has a collar 26 pressed into the interior of the tube 14 near the yoke end thereof. In other embodiments the collar 26 may be welded to the interior of the outer sleeve 14. Fixed to the collar 26 is a threaded rod 28 that extends axially within a major axial portion of the outer sleeve 14. Cooperating with the threads of the threaded rod 28 are threads 30 on the inner surface of the inner sleeve 14. The threads 30 may be machined on the inside diameter of the inner sleeve 14. Alternatively, a threaded insert may be welded to the interior surface of the inner sleeve 14 near the right end (as viewed) of the inner sleeve 14. Still other embodiments may utilize a commercially available threaded insert that locks in place with a nylon member. It will be understood that the axial dimension intermediate the plate 18 and the base 16 may be verified by the installer by rotating the plate 18 with respect to the base 16. After the desired axial adjustment is completed a set screw locks the outer sleeve 14 to the inner sleeve 12. More specifically, a threaded bore in the left end of the outer sleeve 14, receives the set screw 32 which presses into the outer wall of the inner sleeve 12 to prevent relative axial movement between the inner sleeve 12 and the outer sleeve 14.

Fixed to the left (as viewed) axial extremity of the inner sleeve 12 is spherical member 34. The member 34 is constructed by bolting two opposed hemisphere shaped cast nylon elements onto a tang shaped axial extremity of the inner sleeve 12. The hemisphere shaped elements have countersinks therein to allow the bolting in a manner that does not interfere with the ball and socket cooperation.

The member 34 cooperates with first and second opposed spherical section shaped elements 36 in the base 16. The spherical section shaped inserts 36 are each secured to the housing of the base by a machine screw 38. The countersunk head of that screw 38 is visible in FIG. 1. It will thus be seen that the mounting between the inner sleeve 12 and the base 16 provides substantial adjustability. The end of the outer sleeve 14 that is pivotally connected to the plate 18 has one degree of freedom with respect to the plate 18. However, the installer can also vary the axial position and can also rotate the outer sleeve 14 to provide still further adjustment.

Figure 3:
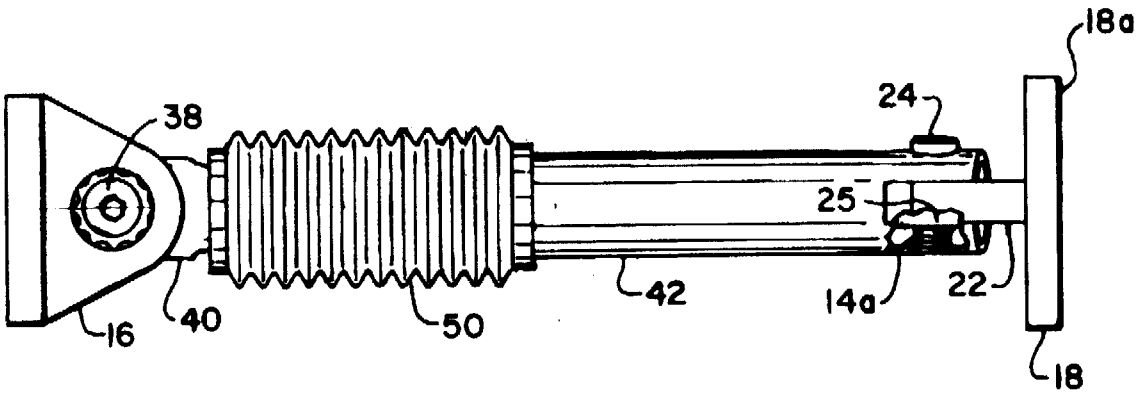
FIG. 3 is a plan view of a second embodiment of the apparatus in accordance with the invention.
Figure 4:
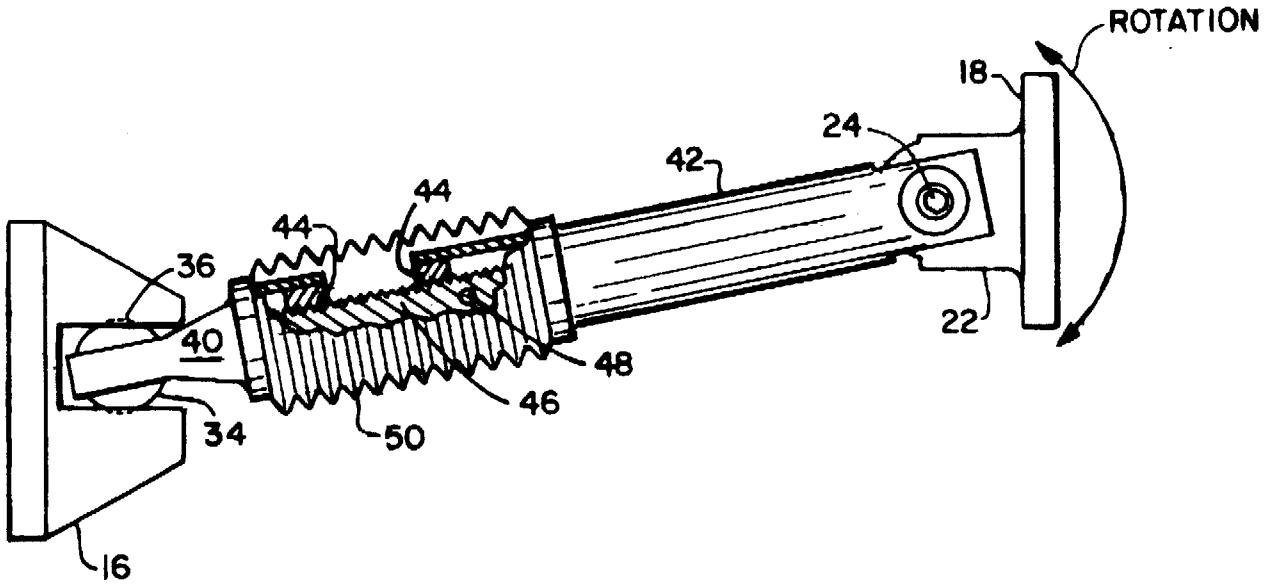
FIG. 4 is a side view of the second embodiment of the apparatus.

The second embodiment of the present invention illustrated in FIGS. 3 and 4 also has first and second sleeves that each include the same base 16 and plate 18. In addition the first and second sleeves are respectively joined to the base 16 and the plate 18 in the same manner as in the first embodiment.

Unlike the embodiment of FIGS. 1 and 2 the second embodiment does not have telescoping first and second tubes. Instead, the first sleeve 40 and the second sleeve 42 each have a substantially coaxial insert 44 disposed on the inner surface. Ordinarily, both inserts 44 will have right hand threads. Although the drawing shows a discrete insert of a type that may be welded to the sleeve or may be secured by a nylon element, those skilled in the art will recognize that the threads may also be machined into the inner surface of the respective sleeves.

Cooperating with the inserts 44 in the respective sleeves 40, 42 is a single threaded rod 46. It will be seen that axial adjustment of the assembly is achieved by relative rotation of the base 16 with respect to the plate 18. A set screw 48 cooperates with a threaded bore in the sleeve 42 to block the sleeve 42 with respect to the rod 46. For aesthetic purposes an axial portion of the sleeve 40, an axial portion of the sleeve 42, and the rod 46 are covered by a convoluted rubber boot 50. It will thus be seen that both embodiments of the present invention provide substantially increased adjustments for the door holder and that this enables the installer to avoid obstructions while also ensuring that it is possible to precisely position of the open door.

Persons skilled in the art of such devices may upon exposure to the teachings herein, conceive other variations. Such variations are deemed to be encompassed by the disclosure, the invention being delimited only by the following claims.

Having thus described our invention we claim:

1. A door holder assembly for use with an associated electromagnet and an associated door having a pneumatic or hydraulic door closer mechanism mounted thereon which comprises:

an elongated body having first and second axial portions;

a threaded member coupled to said first axial portion and to said second axial portion, said threaded member being coupled to one of said axial portions by mating threaded surfaces whereby relative rotation of said first and second axial portions varies the combined axial extent of said elongated body;

said assembly further including a plate at one end of said elongated body and a base at the other end of said elongated body, said base and said plate each being mounted on said elongated body by means that allows relative angular movement therebetween, said means that allows relative angular movement at a first end of said elongated body is a pivot connection, said means that allows relative angular movement at a second end of said elongated body is a spherical member that is mounted between first and second opposed plates, each of said first and second opposed plates having spherical section shaped recesses therein meshing with said spherical member, said spherical member comprising first and second opposed hemisphere shaped elements;

said second end being tang shaped and said first and second opposed hemisphere shaped elements are mounted on opposed sides of said tang shaped second end and said apparatus further includes a screw extending through said first and second opposed hemisphere shaped elements and said tang shaped second end;

said screw has a head and said head is countersunk in one of said hemisphere shaped elements.

2. The apparatus as described in claim 1 wherein:

said apparatus further includes a bushing surrounding said screw within said tang shaped member and said first and second opposed hemisphere shaped elements.

* * * * *